US008261717B2

(12) United States Patent
Peotter et al.

(10) Patent No.: US 8,261,717 B2
(45) Date of Patent: Sep. 11, 2012

(54) SERVICE PACK POWER MANAGEMENT

(75) Inventors: Benjamin G. Peotter, Kaukauna, WI (US); Ross Renner, Black Creek, WI (US)

(73) Assignee: Illinois Tool Works Inc., Glenview, IL (US)

( * ) Notice: Subject to any disclaimer, the term of this patent is extended or adjusted under 35 U.S.C. 154(b) by 755 days.

(21) Appl. No.: 12/361,394

(22) Filed: Jan. 28, 2009

(65) Prior Publication Data

US 2009/0194067 A1 Aug. 6, 2009

Related U.S. Application Data

(60) Provisional application No. 61/026,122, filed on Feb. 4, 2008.

(51) Int. Cl.
*F02B 63/00* (2006.01)

(52) U.S. Cl. ..... 123/350; 123/2; 290/1 A; 219/133

(58) Field of Classification Search ..... 123/2, 350; 290/1 A; 219/133
See application file for complete search history.

(56) References Cited

U.S. PATENT DOCUMENTS

| | | | | |
|---|---|---|---|---|
| 3,156,313 | A | 11/1964 | Peterson | |
| 3,319,739 | A | 5/1967 | Mores | |
| 3,587,237 | A | 6/1971 | Pierrat | |
| 3,891,354 | A | 6/1975 | Bosch | |
| 4,029,439 | A | 6/1977 | Adams | |
| 4,293,284 | A | 10/1981 | Carlson et al. | |
| 4,359,137 | A | 11/1982 | Merz et al. | |
| 5,421,705 | A | 6/1995 | Benckert | |
| 5,564,522 | A | 10/1996 | Markin et al. | |
| 6,478,714 | B2 | 11/2002 | Onnen et al. | |
| 6,568,493 | B2 | 5/2003 | Parkert et al. | |
| 7,013,646 | B1 * | 3/2006 | Serkh et al. | 60/698 |
| 7,459,800 | B2 * | 12/2008 | Boisvert et al. | 290/40 C |
| 2005/0133489 | A1 | 6/2005 | Gitter et al. | |
| 2006/0027547 | A1 | 2/2006 | Silvestro | |
| 2006/0100057 | A1 * | 5/2006 | Severinsky et al. | 477/4 |
| 2007/0120538 | A1 * | 5/2007 | Sato | 322/45 |
| 2008/0122195 | A1 | 5/2008 | Beeson et al. | |
| 2008/0264920 | A1 | 10/2008 | Leisner et al. | |
| 2008/0264921 | A1 | 10/2008 | Kropp et al. | |
| 2008/0264922 | A1 | 10/2008 | Fosbinder | |
| 2010/0072757 | A1 * | 3/2010 | Kealy et al. | 290/1 A |

FOREIGN PATENT DOCUMENTS

AU 468888 12/1975

(Continued)

OTHER PUBLICATIONS

U.S. Appl. No. 12/040,328, filed Feb. 29, 2008 by Beeson.

(Continued)

*Primary Examiner* — Erick Solis
(74) *Attorney, Agent, or Firm* — Fletcher Yoder, P.C.

(57) ABSTRACT

A power management system, in certain aspects, may utilize direct load sensing feedback from the prime mover (e.g., engine), thereby reducing the possibility of overloading the prime mover. The use of direct load sense feedback from the prime mover can then be used with additional feedback, such as prime mover RPM feedback and individual output load sensing feedback, to directly control the output loads and set the primary power sources rpm set-point to better manage the power available and reduce the possibility of overloading the primary power source.

17 Claims, 6 Drawing Sheets

FOREIGN PATENT DOCUMENTS

| | | |
|---|---|---|
| AU | 4447185 | 1/1987 |
| DE | 202005000677 | 3/2005 |
| DE | 102004017087 | 11/2005 |
| EP | 0458050 | 11/1991 |
| EP | 0580248 | 1/1994 |
| EP | 1065386 | 1/2001 |
| EP | 1522693 | 4/2005 |
| FR | 2873364 | 1/2006 |
| GB | 959381 | 6/1964 |
| GB | 1290925 | 9/1972 |
| GB | FR2232692 | 1/1975 |
| JP | 6127118 | 12/1986 |
| JP | 61271118 | 12/1986 |
| JP | 06227309 | 8/1994 |
| WO | WO0112967 | 2/2001 |
| WO | WO2007067178 | 6/2007 |
| WO | WO2008067252 | 6/2008 |

OTHER PUBLICATIONS

U.S. Appl. No. 12/358,119, filed Jan. 22, 2009 by Peters.
U.S. Appl. No. 12/358,147, filed Jan. 22, 2009 by Peters.
U.S. Appl. No. 12/040,568, filed Feb. 29, 2008; Beeson.
U.S. Appl. No. 12/358,147, filed Jan. 22, 2009; Peters.
Brochure entitled "HIPPO 2032E"; Mobile Hydraulic Equipment Co, LLC: www.multipower.us; 2 pages.

* cited by examiner

FIG. 3
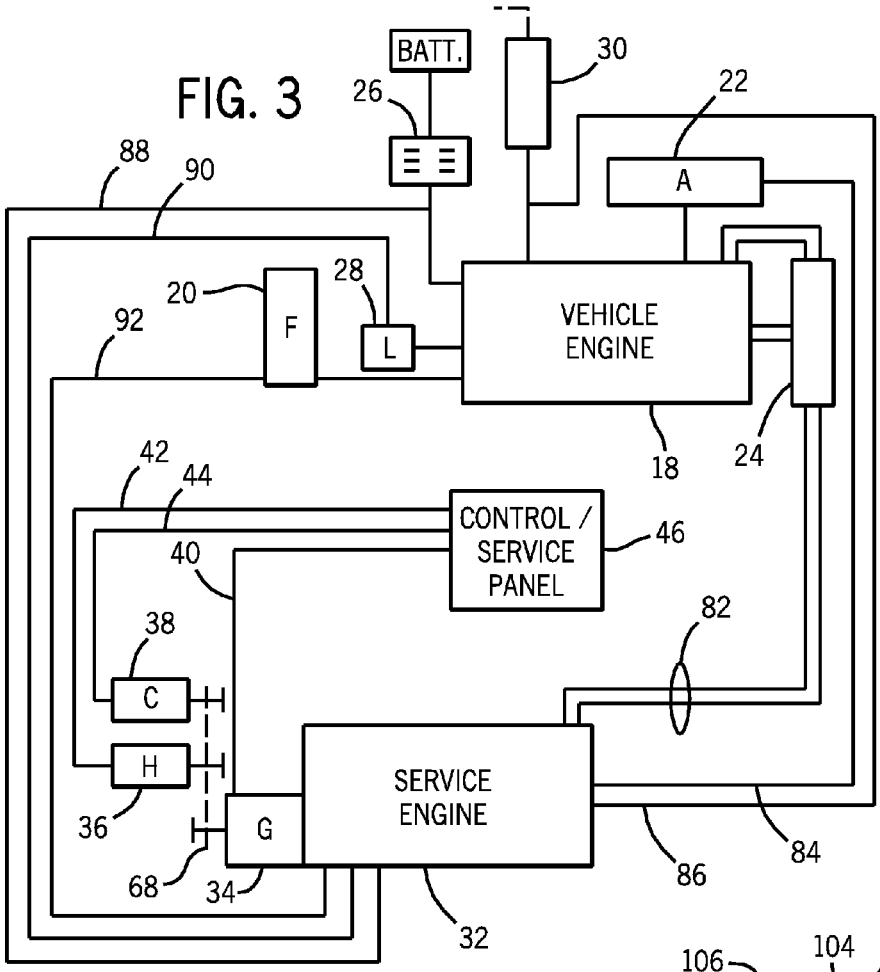
FIG. 4A
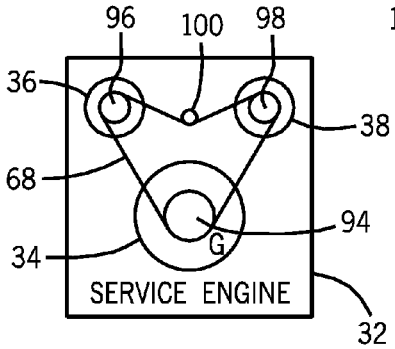
FIG. 4B
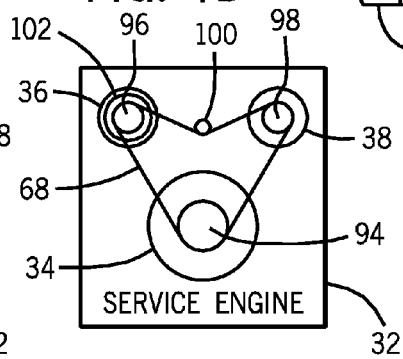
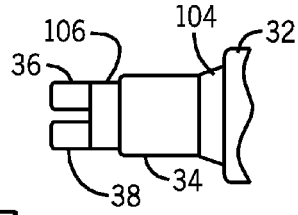
FIG. 4C

SERVICE PACK POWER MANAGEMENT

CROSS REFERENCE TO RELATED APPLICATION

This application claims priority to U.S. Provisional Patent Application No. 61/026,122, entitled "Service Pack Power Management", filed on Feb. 4, 2008, which is herein incorporated by reference in its entirety.

BACKGROUND

The invention relates generally to power management for an engine coupled to loads. More specifically, the invention relates to power management for a service pack having an engine driving various services, such as an air compressor, an electrical generator (e.g., a welding generator), a hydraulic pump, and possibly other loads.

A prime mover (e.g., engine) generally drives various loads, which can potentially overload the engine, reduce fuel efficiency, increase pollutant emissions, and so forth. The overload condition is common in portable generators, such as engine-driven welder-generators. The typical engine is small and, thus, has limited output power to drive the electrical generator. If the engine drives multiple loads, then the overload condition is more likely to occur.

BRIEF DESCRIPTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

A power management system, in certain aspects, may utilize direct load sensing feedback from the prime mover (e.g., engine), thereby reducing the possibility of overloading the prime mover. The use of direct load sense feedback from the prime mover can then be used with additional feedback, such as prime mover RPM feedback and individual output load sensing feedback, to directly control the output loads and set the primary power sources rpm set-point to better manage the power available and reduce the possibility of overloading the primary power source.

DRAWINGS

These and other features, aspects, and advantages of the present invention will become better understood when the following detailed description is read with reference to the accompanying drawings in which like characters represent like parts throughout the drawings, wherein:

FIG. 3 is a diagram of an embodiment of power systems in the vehicle of FIG. 1, illustrating support systems of the service pack highly integrated with support systems of the vehicle engine;

FIGS. 4A-4C are diagrams of the service pack with different arrangements of a generator, a hydraulic pump, and an air compressor driven by a service pack engine in accordance with certain embodiments of the invention;

Figure 5:
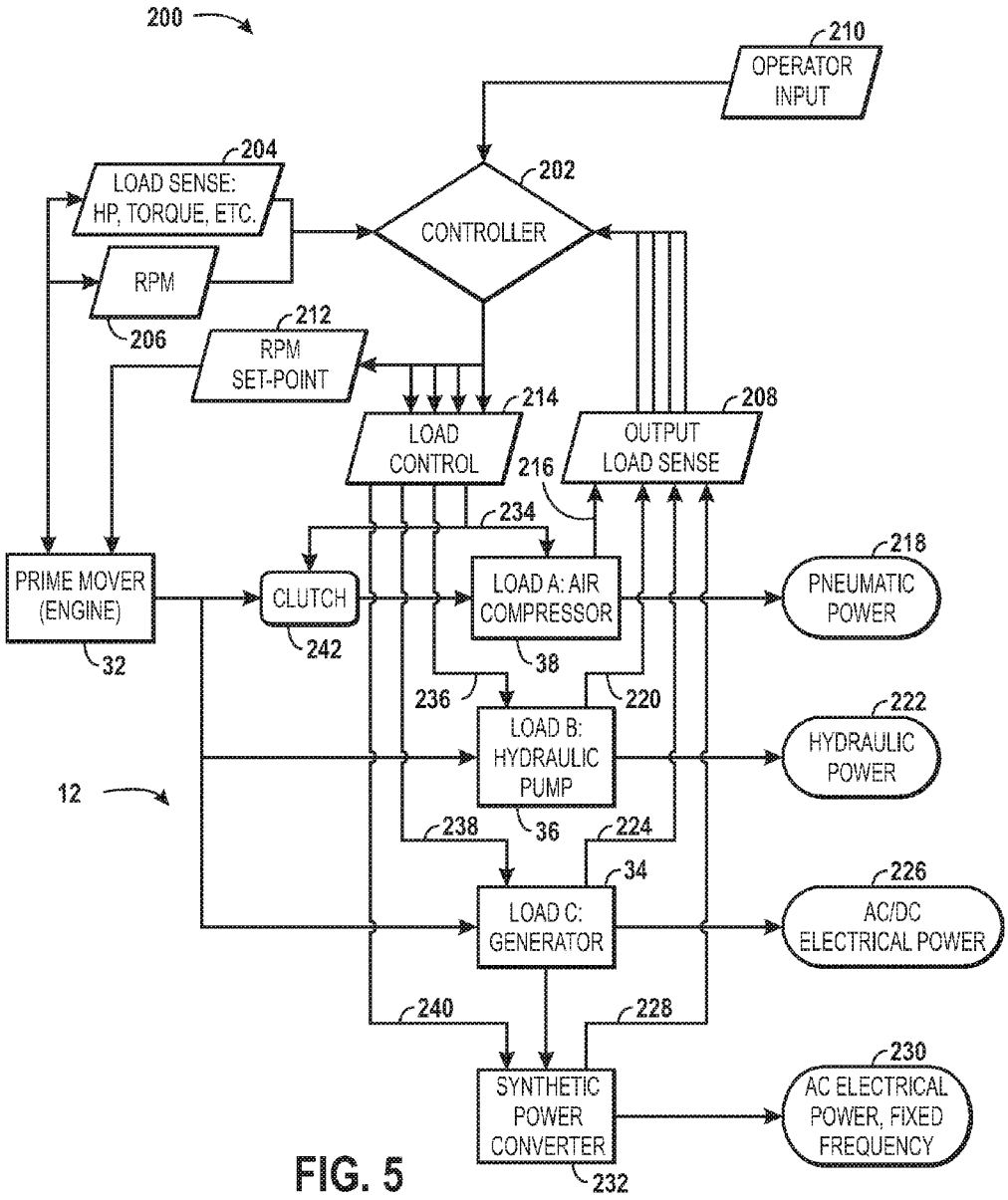
FIG. 5 is a block diagram illustrating an embodiment of the load control system for the service pack of FIGS. 1-4.
Figure 6:
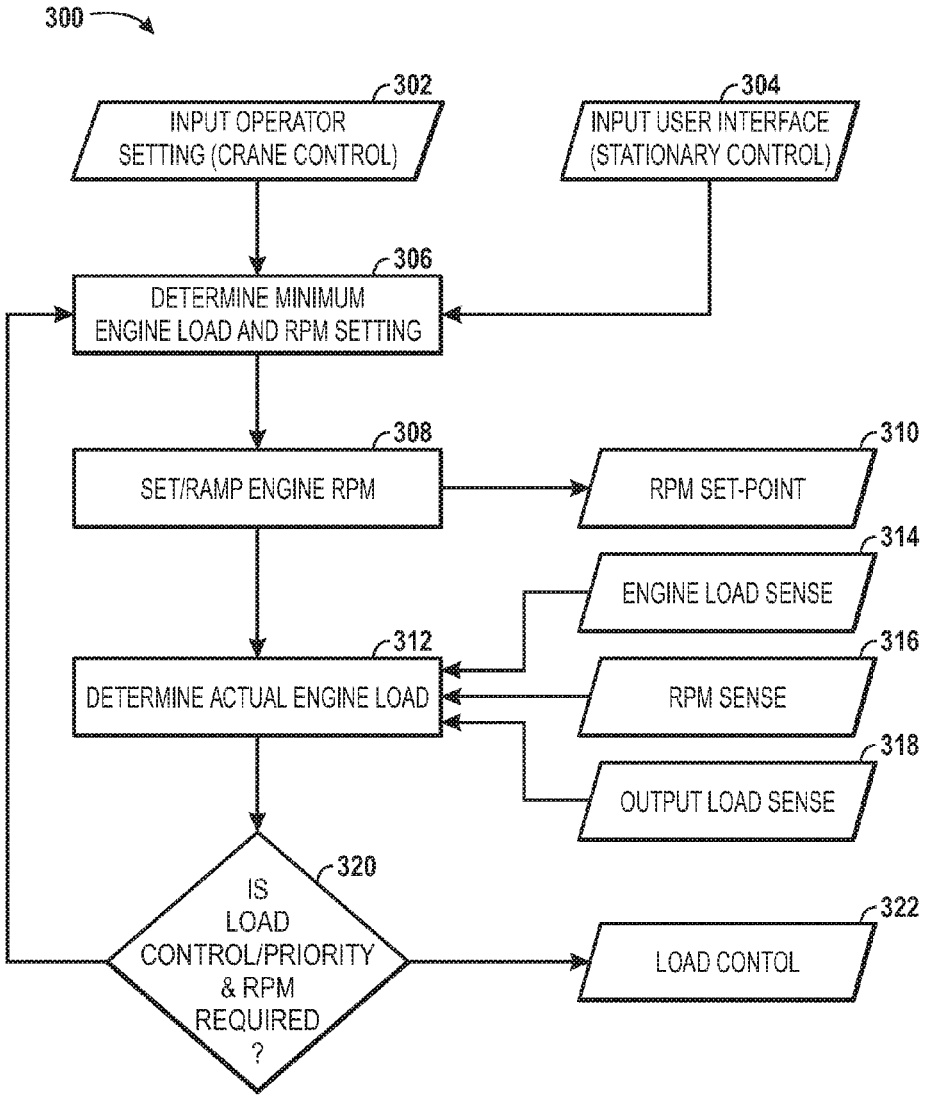
Figure 7:
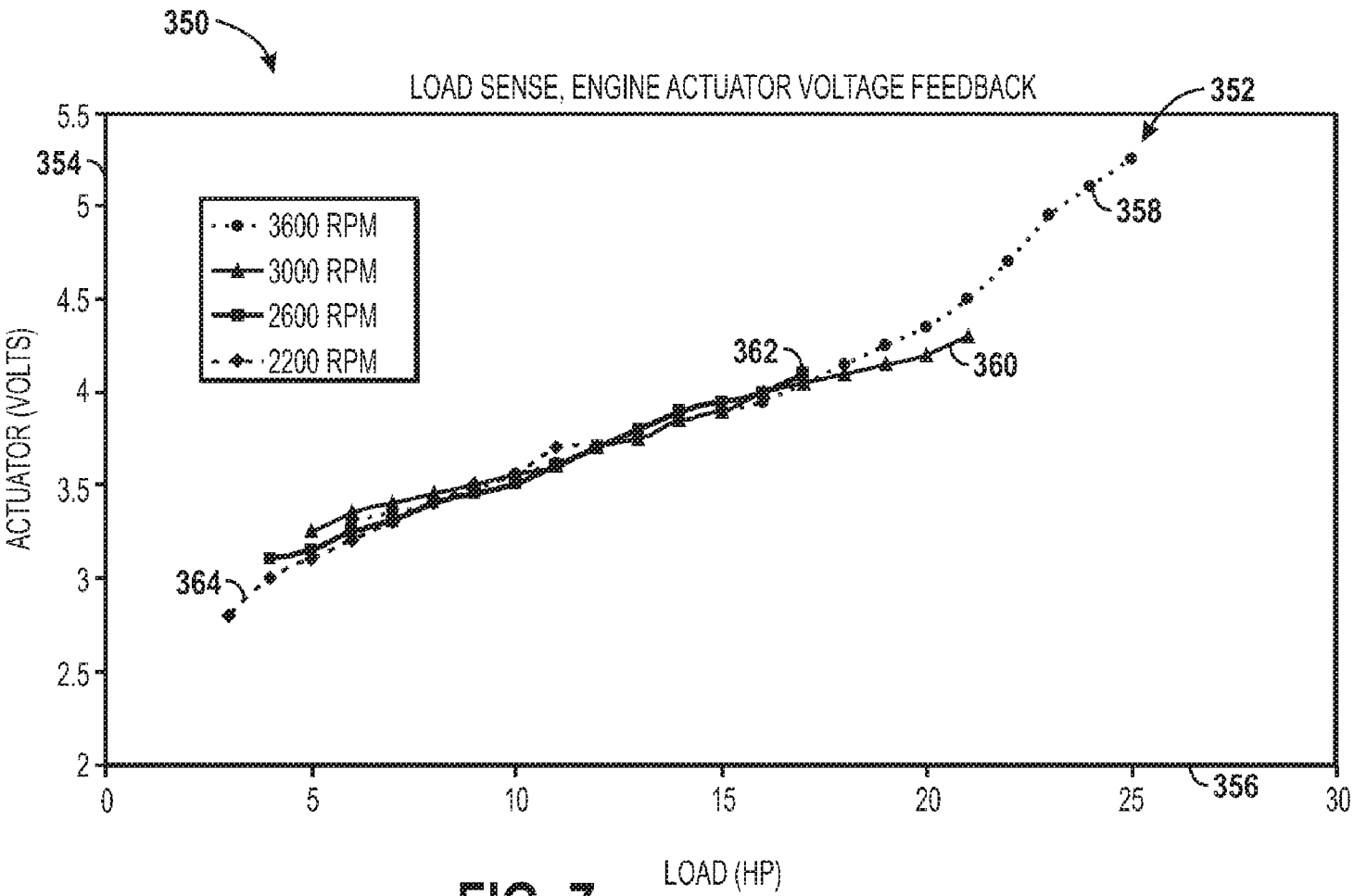

FIG. 6 is a flow chart illustrating an embodiment of a load control process for the service pack of FIGS. 1-4; and FIG. 7 is a graph illustrating a load sense signal used by the load control system and process of FIGS. 5 and 6, wherein the load sense signal relates to an electronic governor proportional solenoid actuator signal in the service pack in accordance with certain embodiments of the invention.

DETAILED DESCRIPTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

In certain embodiments, a prime mover (e.g., an engine) drives one or more loads alone or in combination with one another. The prime mover may include a spark ignition (SI) engine or a compression ignition (CI) engine. In many applications, the size of the prime mover is limited due to constraints in size, weight, cost, and so forth. Unfortunately, the prime mover can become overloaded by one or more loads during operation. For example, the prime mover may drive an electrical generator, a compressor, a hydraulic pump, and so forth. Thus, the loads may include various electrical tools, lights, a welding torch, a cutting torch, and the like. The loads also may include an air tool, a pneumatic spray gun, and the like. Furthermore, the loads may include a hydraulic lift, a hydraulic crane, a hydraulic stabilizer, a hydraulic tool, and the like. Each of these loads has certain demands, which can overload the prime mover either alone or in certain combinations with one another.

One possible solution is to limit each load component (e.g., generator, pump, and compressor) individually to a value less than the prime mover capability. This method is simple and works well for single loads but is limited if applied to simultaneous multiple loaded systems and will not prevent the prime mover from potential overload conditions.

Another possible solution is to limit each component (e.g., generator, pump, and compressor) individually so that the maximum combined total load does not exceed the prime movers capability. This method will work for single and multiple simultaneous loads but will severely limit the individual output of each component or loads.

Another possible solution is active control of one or multiple load elements (e.g., generator, pump, and compressor) from overloading the prime mover by individual output load sensing and control in combination with indirect engine overload sensing by using the RPM feedback of the prime mover to sense overload. This method will work for single and multiple simultaneous loads, but it is highly sensitive to the primary power source RPM/load response and/or governor controls, initial RPM set-point, and so forth. In order for the system to operate effectively, significant RPM/load response or governor drop may be required for acceptable RPM feedback. This RPM drop vs. load requirement effectively reduces the output of the prime mover as the power output of most prime movers is related to RPM. In addition, this system does not work well with modern zero drop control systems, electronic governors, as RMP drop is effectively zero until the prime mover is at a state of overload. In addition, this system does not have the capability to handle or manage multiple RPM set-points of the primary power source.

As discussed below, embodiments of the present technique provide a uniquely effective solution to power management in various applications. Thus, the disclosed embodiments relate or deal with any application where a prime mover or power source power is limited in power, such as CI or SI engine, and the load or combination of loads have the potential to overload the prime mover. In certain embodiments, the disclosed power management techniques may be used with various service packs to prevent an overload condition of a diesel engine power source that is directly coupled to multiple loads, specifically an air compressor, hydraulic pump, auxiliary AC electric generator, where the individual and/or combination of these loads have the potential to overload the diesel power source. For example, the disclosed embodiments may be used in combination with any and all of the embodiments set forth in U.S. application Ser. No. 11/742,399, filed on Apr. 30, 2007, and entitled "ENGINE-DRIVEN AIR COMPRESSOR/GENERATOR LOAD PRIORITY CONTROL SYSTEM AND METHOD," which is hereby incorporated by reference in its entirety. By further example, the disclosed embodiments may be used in combination with any and all of the embodiments set forth in U.S. application Ser. No. 11/943,564, filed on Nov. 20, 2007, and entitled "AUXILIARY SERVICE PACK FOR A WORK VEHICLE," which is hereby incorporated by reference in its entirety.

As discussed below, the present embodiments utilize direct load sensing feedback from the prime mover (e.g., engine), thereby substantially reducing or preventing the possibility of overloading the prime mover. The use of direct load sense feedback from the prime mover can than be used with additional feedback, such as prime mover RPM feedback and individual output load sensing feedback, to directly control the output loads and set the primary power source's RPM set-point to better manage the power available and prevent overloading of the primary power source. For example, in certain embodiments, a controller may acquire direct load sensing feedback from the prime mover (e.g., engine), such as throttle/actuator position of a fuel injection system. In particular, the throttle/actuator position indicates a quantity of fuel injection into the prime mover, which quantity is a direct indicator of load on the prime mover. In other words, as the throttle/actuator moves to increase fuel injection, it indicates a greater load on the prime mover. Likewise, as the throttle/actuator moves to decrease fuel injection, it indicates a lesser load on the prime mover. The controller also may acquire engine feedback, such as RPM, exhaust temperature, torque, power output, fuel injection quantity, throttle position, and other parameters that may be indicative of load on the prime mover. Furthermore, the controller may acquire feedback associated with the services (e.g., generator, pump, and compressor) loading the prime mover. For example, the controller may acquire feedback associated with electrical power supply or demand of the generator, fluid flow or pressure associated with the pump, and air pressure or flow associated with the compressor. The controller may then use the feedback to adjust the engine and/or one or more of the services (e.g., generator, pump, and compressor) to power match the capabilities of the prime mover with the loads imparted by the services. For example, the controller may adjust engine parameters, such as fuel injection, spark timing, throttle position, RPM, or a combination thereof, in response to the feedback. Likewise, the controller may adjust load outputs, such as electrical current, electrical voltage, air pressure, air flow rate, hydraulic pressure, hydraulic flow rate, power level, torque, or a combination thereof, in response to the feedback.

Figure 1:
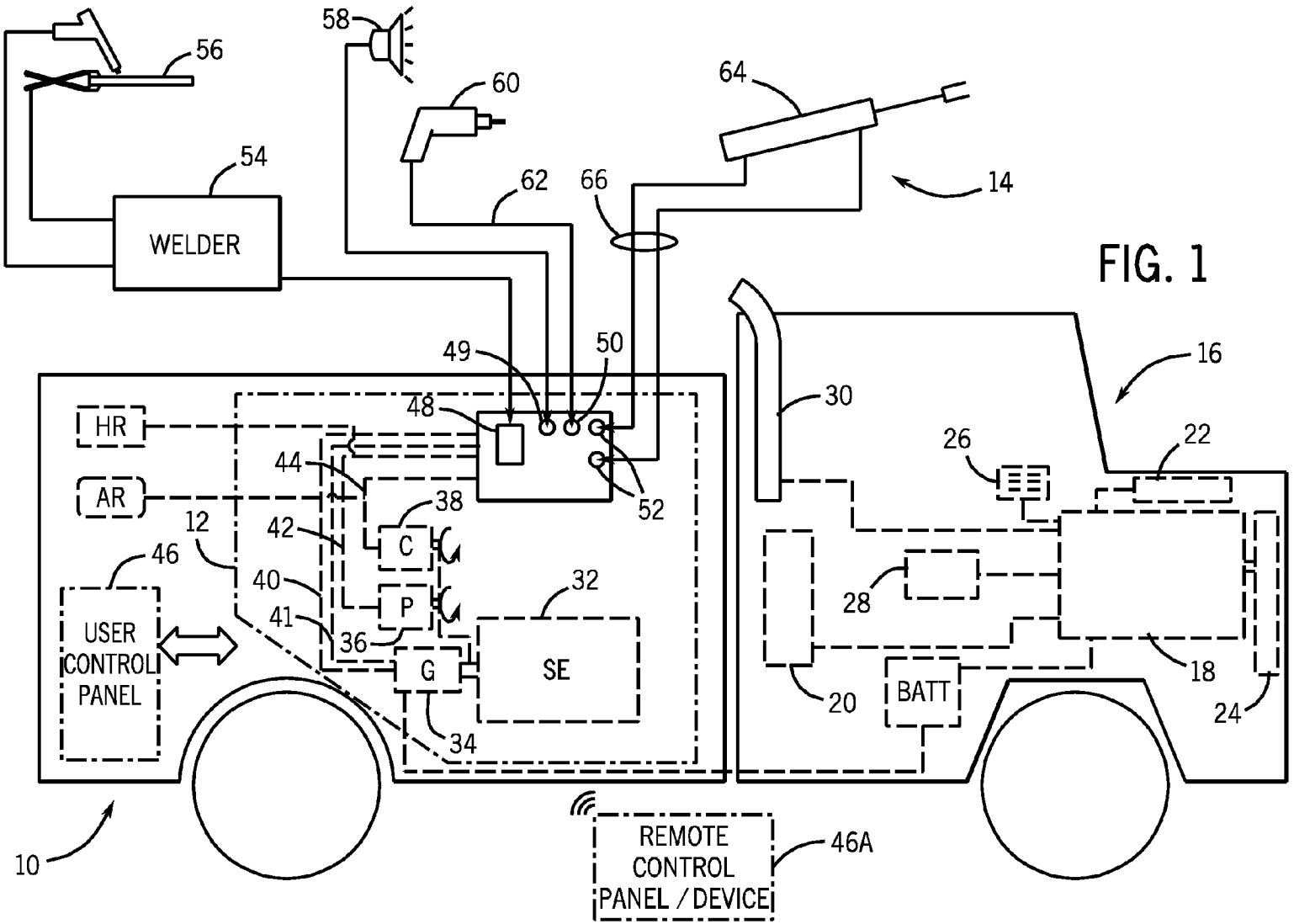
FIG. 1 is a diagram of a work vehicle having a service pack with a load control system in accordance with certain embodiments of the invention.

Turning now to the drawings, and referring first to FIG. 1, a work vehicle 10 is illustrated including equipment in accordance with embodiments of the invention. The work vehicle 10 is shown as a work truck, although the work vehicle 10 may have any other suitable configuration. In the illustrated embodiment, the vehicle 10 includes a service pack 12 for supplying various services (e.g., electrical, compressed air, and hydraulic power) to a range of applications 14. As discussed in detail below, the service pack 12 includes a unique load control system and process configured to adjust the various services based on load sense feedback. The vehicle 10 has a main vehicle power plant 16 based around a vehicle engine 18. The main vehicle engine 18 may include a spark ignition engine (e.g., gasoline fueled internal combustion engine) or a compression ignition engine (e.g., a diesel fueled engine), for example, an engine with 6, 8, 10, or 12 cylinders with over 200 horsepower.

The vehicle power plant 16 includes a number of support systems. For example, the engine 18 consumes fuel from a fuel reservoir 20, e.g., one or more liquid fuel tanks. An air intake or air cleaning system 22 supplies air to engine 18, which may, in some applications, be turbo charged or super charged. A cooling system 24, e.g., a radiator, circulation pump, a thermostat-controlled valve and a fan, provides for cooling the engine 18. The vehicle power plant 16 also includes an electrical system 26, which may include an alternator or generator, along with one or more system batteries, cabling for these systems, cable assemblies routing power to a fuse box or other distribution system, and so forth. The vehicle power plant 16 also includes a lube oil system 28, which may draw oil from the engine crankcase, and circulate the oil through a filter and cooler, if present, to maintain the oil in good working condition. Finally, the power plant 16 includes an exhaust system 30, which may include catalytic converters, mufflers, and associated conduits.

The service pack 12 may include one or more service systems driven by a service engine 32. In a present embodiment, the service pack provides electrical power, hydraulic power, and compressed air for the applications 14. In the diagrammatical representation of FIG. 1, for example, the service engine drives a generator 34 as well as a hydraulic pump 36 and air compressor 38. As discussed in detail below, the service pack 12 may measure various loads (e.g., load sense) associated with the service engine 32 via a direct measurement of engine load relating to the service engine 32, a measurement of generator load relating to the generator 34, a measurement of hydraulic pump load relating to the hydraulic pump 36, and/or a measurement of compressor load relating to the air compressor 38. In response to the load sense, the service pack 12 may adjust these loads to power match the capabilities of the engine 32 with the demands of the service systems, e.g., generator 34, pump 36, and compressor 38. For example, in order to provide this power matching feature, the control system functions to control the power consumption of the generator 34, pump 36, and compressor 38 so as not to overpower the smaller engine 32.

The service engine 32 may include a spark ignition engine (e.g., gasoline fueled internal combustion engine) or a compression ignition engine (e.g., a diesel fueled engine), for example, an engine with 1-4 cylinders with approximately 10-80 horsepower. In some embodiments, the service engine 32 may be a small engine with approximately 10, 20, 30, 40, or 50 horsepower. The generator 34 may be directly driven by the engine 32, such as by close coupling the generator 34 to the engine, or may be belt or chain driven, where desired. Presently contemplated generators 34 include three-phase brushless types, capable of producing power for a range of applications. However, other generators 34 may be employed, including single-phase generators and generators capable of producing multiple power outputs. The hydraulic pump 36 may be based on any suitable technology, such as piston pumps, gear pumps, vane pumps, with or without closed-loop control of pressure and/or flow. In certain embodiments, the pump 36 may include a constant displacement pump, a variable displacement pump, a plurality of pumps in a parallel or series configuration, or a combination thereof. The air compressor 38 may also be of any suitable type, e.g., a rotary screw air compressor. Other suitable compressors might include reciprocating compressors typically based upon one or more reciprocating pistons.

The systems of the service pack 12 include appropriate conduits, wiring, tubing and so forth for conveying the service generated by these components to an access point. Convenient access points will be located around the periphery of the vehicle. In a presently contemplated embodiment, all of the services may be routed to a common access point, although multiple access points can certainly be envisaged. The diagrammatical view of FIG. 1 illustrates the generator 34 as being coupled to electrical cabling 40 (for AC power supply) and 41 (for 12 volt DC power supply), whereas the hydraulic pump 36 is coupled to hydraulic circuit 42, air compressor 38 is coupled to an air circuit 44. The wiring and circuitry for all three systems includes protective circuits for the electrical power, including fuses, circuit breakers, and so forth, as well as valving for the hydraulic and air service. For the supply of electrical power, certain types of power may be conditioned (e.g., smoothed, filtered, etc.), and 12 volt power output may be provided by rectification, filtering and regulating of AC output. Valving for hydraulic power output may include by way example, pressure relief valves, check valves, shut-off valves, as well as directional control valving. Moreover, it should be understood that, although not represented specifically in FIG. 1, the hydraulic pump draws fluid from and returns fluid to a fluid reservoir, which includes an appropriate vent for the exchange of air during use with the interior volume of the reservoir, as well as a strainer or filter for the hydraulic fluid. Similarly, the air compressor 38 draws air from the environment through an air filter.

As represented generally in FIG. 1, the generator 34 is also coupled to the vehicle electrical system, and particularly to the vehicle battery. Thus, as described below, not only may the service pack 12 allow for 12 volt loads to be powered without operation of the main vehicle engine 18, but the vehicle battery may serve as a shared battery, and is maintained in a good state of charge by the service pack 12 generator output.

The cabling and conduits 40, 41, 42 and 44 may, as in the illustrated embodiment, route service for all of these systems directly from connections on the service pack 12. In a presently contemplated embodiment, for example, connections are provided at or near a base of an enclosure of the service pack 12, such that connections can be easily made without the need to open the enclosure. Moreover, certain control functions may be available from a control and service panel 46. The service panel 46, as noted above, may be located on any surface of the vehicle 10, or on multiple locations in the vehicle 10, and may be covered by doors or other protective structures, where desired. There is no requirement, generally, that the service panel 46 be located at the same location, or even near the locations of access to the electrical, hydraulic or compressed air output points of the service pack 12. In a presently contemplated embodiment, the panel is provided in a rear compartment covered by an access door. The control and service panel 46 may permit, for example, starting and stopping of the service engine 32 by a keyed ignition or starter button. Other controls for the engine may also be provided on the control and service panel 46. The control and service panel 46 may also provide operator interfaces for monitoring the service engine 32, such as fuel level gages, pressure gages, as well as various lights and indicators for parameters such as pressure, speed, and so forth. The service panel 46 may also include a stop, disconnect or disable switch (not separately shown) that allows the operator to prevent starting of the service pack engine 32, such as during transport.

As also illustrated in FIG. 1, a remote control panel or device 46A may also be provided that may communicate with the control panel 46 or directly with the service pack 12 via cabling or wirelessly. In a manner similar to conventional crane or manlift controls, then, the operator may start and stop the service pack engine 32, and control certain functions of the service pack 12 (e.g., engagement or disengagement of a clutched component, such as an air compressor) without directly accessing either the components within the service pack enclosure or the control panel 46.

As noted above, any desired location may be selected as a convenient access point for one or more of the systems of the service pack 12. In the illustrated embodiment, for example, one or more alternating current electrical outputs, which may take the form of electrical receptacles 48 (for AC power) and 49 (for 12 volt DC power) are provided. Similarly, one or more pneumatic connections, typically in the form of a quick disconnect fitting may be provided as indicated at reference numeral 50. Similarly, hydraulic power and return connections 52 may be provided, which may also take the form of quick disconnect fittings.

In the embodiment illustrated in FIG. 1, the applications 14 may be coupled to the service pack 12 by interfacing with the outputs provided by receptacle 48. For example, a portable welder 54 may be coupled to the AC electrical output 48, and may provide constant current or constant voltage-regulated power suitable for a welding application. The welder 54 may receive power from the electrical output of the generator 34, and itself contain circuitry designed to provide for appropriate regulation of the output power provided to cables suitable for a welding application 56. The presently contemplated embodiments include welders, plasma cutters, and so forth, which may operate in accordance with any suitable welding techniques, such as stick welding, tungsten inert gas (TIG) welding, metal inert gas (MIG) welding, and so forth. Although not illustrated in FIG. 1, certain of these welding techniques may call for or conveniently use wire feeders to supply a continuously fed wire electrode, as well as shielding gasses and other shielding supplies. Such wire feeders may be coupled to the service pack 12 and powered by the service pack 12, where desired.

Similarly, DC loads may be coupled to the DC receptacle 49. Such loads may include lights 58, or any other loads that would otherwise be powered by operation of the main vehicle engine 18. As mentioned above, the 12 volt DC output of the service pack 12 also serves to maintain the vehicle battery charge, and to power any ancillary loads that the operator may need during work (e.g., cab lights, hydraulic system controls, etc.).

The pneumatic and hydraulic applications may be similarly coupled to the service pack 12 as illustrated diagrammatically in FIG. 1. For example, a hose 62 or other conduit may be routed from the compressed air source at the outlet 50 to a tool, such as an impact wrench 60. Many such pneumatic loads may be envisaged. Similarly, a hydraulic load, illustrated in the form of a reciprocating hydraulic cylinder 64 may be coupled to the hydraulic service 52 by appropriate hoses or conduits 66. As noted above, certain of these applications, particularly the hydraulic applications, may call for the use of additional valving, particularly for directional control and load holding. Such valving may be incorporated into the work vehicle 10 or may be provided separately either in the application itself or intermediately between the service pack 12 and the hydraulic actuators. Certain of the applications illustrated diagrammatically in FIG. 1 may be incorporated into the work vehicle 10. For example, the work vehicle 10 may be designed to include a man lift, scissor lift, hydraulic tail gate, or any other driven systems, which can be coupled to the service pack 12 and driven separately from the main vehicle engine 18.

The service pack 12 may be physically positioned at any suitable location in the vehicle 10. In a presently contemplated embodiment, for example, the service engine 32 may be mounted on, beneath or beside the vehicle bed or work platform rear of the vehicle cab. In many such vehicles 10, for example, the vehicle chassis may provide convenient mechanical support for the engine and certain of the other components of the service pack 12. For example, steel tubing, rails or other support structures extending between front and rear axles of the vehicle 10 may serve as a support for the service engine 32. It should be noted that, depending upon the system components selected and the placement of the service pack 12, reservoirs may be provided for storing hydraulic fluid and pressurized air (denoted HR and AR, respectively in FIG. 1). However, the hydraulic reservoir may be placed at various locations or even integrated into the service pack enclosure. Likewise, depending upon the air compressor selected, no reservoir may be included for compressed air.

In use, the service pack 12 provides power for the on-site applications 14 completely separately from the vehicle engine 18. That is, the service engine 32 generally may not be powered during transit of the vehicle 10 from one service location to another, or from a service garage or facility to a service site. Once located at the service site, the vehicle 10 may be parked at a convenient location, and the main engine 18 may be shut down. The service engine 32 may then be powered, to provide service from one or more of the service systems (e.g., generator 34, hydraulic pump 36, and air compressor 38) described above. The service pack 12 also may include clutches, or other mechanical engagement devices, for selective engagement and disengagement of one or more of the generator 34, the hydraulic pump 36, and the air compressor 38, alone or in combination with one another. Moreover, the vehicle 10 may include outriggers, stabilizers, and other mechanical supports, which may be deployed after parking the vehicle 10 and prior to operation of the service pack 12. The disclosed embodiments thus allow for a service to be provided in several different manners and by several different systems without the need to operate the main vehicle engine 18 at a service site.

Figure 2:
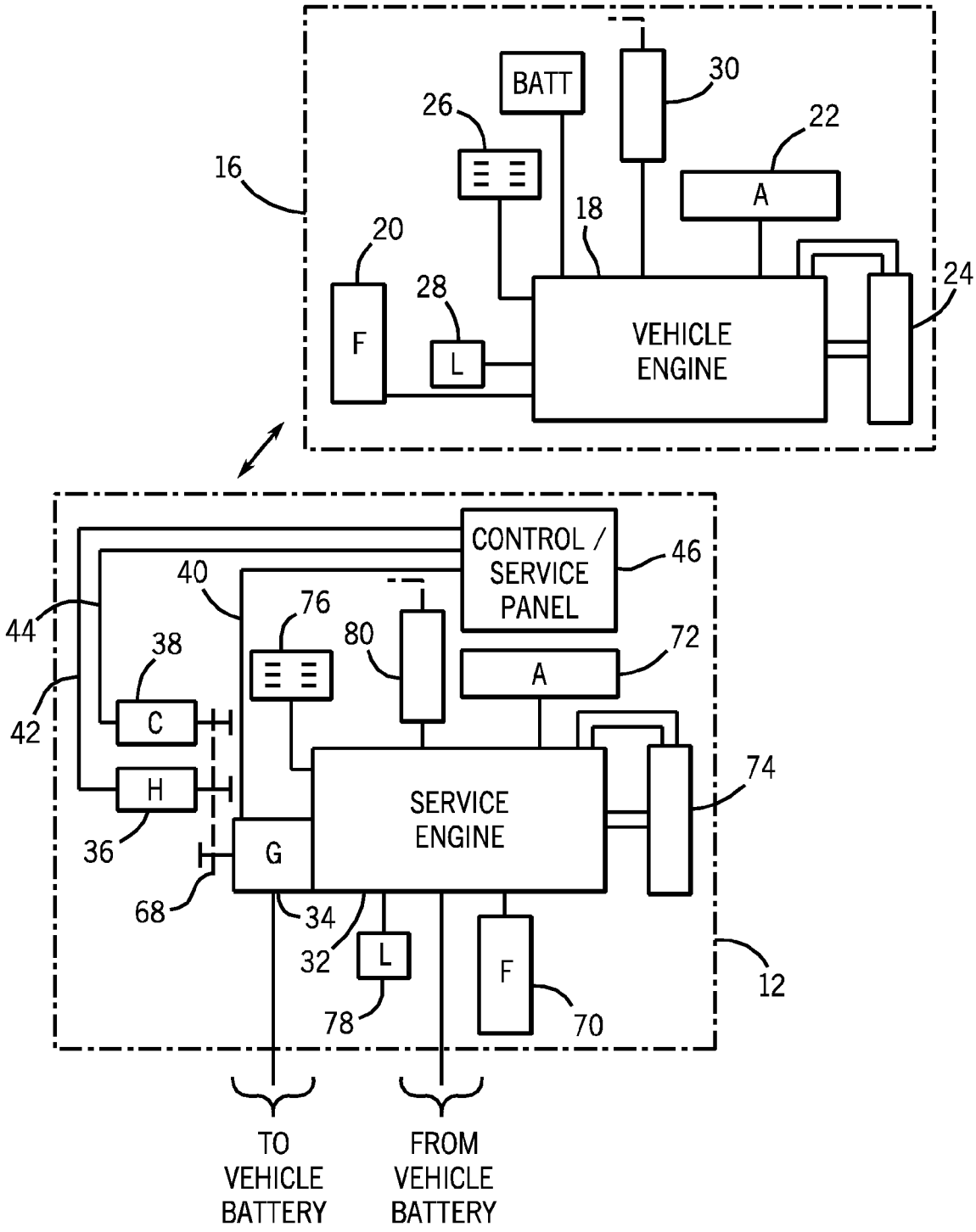
FIG. 2 is a diagram of an embodiment of power systems in the vehicle of FIG. 1, illustrating support systems of the service pack completely separate and independent from support systems of a vehicle engine.

Several different scenarios may be envisaged for driving the components of the service pack 12, and for integrating or separating the support systems of the service pack 12 from those of the vehicle power plant 16. One such approach is illustrated in FIG. 2, in which the service pack 12 is entirely independent and operates completely separately from the vehicle power plant 16. In the embodiment illustrated in FIG. 2, as shown diagrammatically, the support systems for the vehicle power plant 16 are coupled to the vehicle engine 18 in the manner set forth above. The service pack 12 reproduces some or all of these support systems for operation of the service engine 32. In the illustrated embodiment, for example, these support systems include a separate fuel reservoir 70, a separate air cleaner system 72, a separate cooling system 74, a separate electrical protection and distribution system 76, a separate lube oil system 78, where desired for the engine, and a separate exhaust system 80.

Many or all of these support systems may be provided local to the service engine 32, that is, at the location where the service engine 32 is supported on the vehicle 10. On larger work vehicles, access to the location of the service engine 32 and the service pack 12 in general, may be facilitated by the relatively elevated clearance of the vehicle 10 over the ground. Accordingly, components such as the fuel reservoir, air cleaner, cooling system radiator, electrical fuse box, and so forth may be conveniently positioned so that these components can be readily serviced. Also, in the illustrated embodiment, the hydraulic pump 36 and air compressor 38 are illustrated as being driven by a shaft extending from the generator 34, such as by one or belts or chains 68. As noted above, one or both of these components, or the generator 34 may be provided with a clutch or other mechanical disconnect to allow them to idle while other systems of the service pack are operative.

FIG. 3 represents an alternative configuration in which the service pack support systems are highly integrated with those of the main vehicle power plant 16. In the illustration of FIG. 3, for example, all of the systems described above may be at least partially integrated with those of the vehicle power plant 16. Thus, coolant lines 82 are routed to and from the vehicle cooling system 24, while an air supply conduit 84 is routed from the air intake or cleaner 22 of the vehicle engine. Similarly, an exhaust conduit 86 routes exhaust from the service engine 32 to the exhaust system 30 of the vehicle engine 18. The embodiment of FIG. 3 also illustrates integration of the electrical systems of the vehicle 10 and the service pack 12, as indicated generally by the electrical cabling 88 which routes electrical power to the distribution system 26 of the vehicle. The systems may also integrate lube oil functions, such that lubricating oil may be extracted from both crank cases in common, to be cleaned and cooled, as indicated by conduit 90. Finally, a fuel conduit 92 may draw fuel from the main reservoir 20 of the vehicle, or from multiple reservoirs where such multiple reservoirs are present on the vehicle.

In presently contemplated embodiments, integrated systems of particular interest include electrical and fuel systems. For example, while the generator 34 of the service pack 12 may provide 110 volt AC power for certain applications, its ability to provide 12 volt DC output is particularly attractive to supplement the charge on the vehicle batteries, for charging other batteries, and so forth. The provision of both power types, however, makes the system even more versatile, enabling 110 volt AC loads to be powered (e.g., for tools, welders, etc.) as well as 12 volt DC loads (e.g., external battery chargers, portable or cab-mounted heaters or air conditioners, etc.).

In certain embodiments, a system may include an integration solution between those shown in FIG. 2 and FIG. 3. For example, some of the support systems may be best separated in the vehicle 10 both for functional and mechanical or flow reasons. The disclosed embodiments thus contemplate various solutions between those shown in FIG. 2 and FIG. 3, as well as some degree of elimination of redundancy between these systems. In a presently contemplated embodiment, at least some of the support systems for the primary vehicle engine 18 are used to support the service pack 12 power plant. For example, at least the fuel supply and electrical systems can be at least partially integrated to reduce the redundancy of these systems. The electrical system may thus serve certain support when the vehicle engine is turned off, removing dependency from the electrical system, or charging the vehicle batteries. Similarly, heating, ventilating and air conditioning systems may be supported by the service pack engine 32, such as to provide heating of the vehicle cab when the primary engine 18 is turned off. Thus, more or less integration and removal of redundancy is possible.

The foregoing service pack systems may also be integrated in any suitable manner for driving the service components, particularly the generator 34, hydraulic pump 36, and air compressor 38, and particularly for powering the on-board electrical system. FIGS. 4A-4C illustrate simplified diagrams of certain manners for driving these components from the service engine 32. In the embodiment illustrated in FIG. 4A, the generator 34 may be close-coupled to the output of the engine 32, such as directly to the engine fly wheel or to a shaft extending from the engine 32. This coupling may be disposed in a support housing used to support the generator 34 on the engine block or other engine support structures. A sheave 94 is mounted to an output shaft extending from the generator (not shown in FIG. 4), and similar sheaves 96 and 98 are coupled to the hydraulic pump 36 and air compressor 38. One or more belts 38 and/or clutches are drivingly coupled between these components, and an idler 100 may be provided for maintaining tension on the belt. Such an arrangement is shown in FIG. 4B, in which the hydraulic pump 36 is driven through a clutch 102, such as an electric clutch. Although not shown specifically, any one of the components may be similarly clutched to allow for separate control of the components. Such control may be useful for controlling the power draw on the engine 32, particularly when no load is drawn from the particular component, and when the component is not needed for support of the main vehicle engine systems (e.g., maintaining a charge on the vehicle batteries).

These components may be supported in any suitable manner, and may typically include some sort of rotating or adjustable mount such that the components may be swung into and out of tight engagement with the belt to maintain the proper torque-carrying tension on the belt and avoid slippage. More than one belt may be provided on appropriate multi-belt sheaves, where the torque required for turning the components is greater than that available from a single belt. Other arrangements, such as chain drives, may also be envisaged. Moreover, as described above, the generator 34 may also be belt or chain driven, or more than one component may be driven directly by the engine 32, such as in an in-line configuration. In a further alternative arrangement, one or more of the components may be gear driven, with gearing providing any required increase or decrease in rotational speed from the output speed of the engine 32. An exemplary arrangement of this type is shown diagrammatically in FIG. 4C. In the illustrated arrangement, a support adapter 104 mounts the generator 34 on the service engine 32, and the hydraulic pump 36 and air compressor 38 are driven by a gear reducer. In such arrangements, one or more clutches may still be provided upstream or downstream of the gear reducer for selective control of the components.

The particular component or components that are directly and/or indirectly driven by the engine 32 may be selected based upon the component and engine specifications. For example, it may be desirable to directly drive the hydraulic pump 36, and to drive the generator 34 via a belt or gear arrangement, permitting the engine 32 to operate at a higher speed (e.g., 3000 RPM) while allowing a reduced speed to drive the generator (e.g., 1800 RPM for near 60 Hz AC output of a 4 pole generator).

FIG. 5 is a block diagram illustrating an embodiment of a load control system 200 for the service pack 12 of FIGS. 1-4. As illustrated, the load control system 200 interfaces with the prime mover or service engine 32, the air compressor 38 as Load A, the hydraulic pump 36 as Load B, and the generator 34 as Load C. The service engine 32 is configured to selectively drive one or more of the Loads A, B, and C (e.g., compressor 38, pump 36, and generator 34) based on load sense feedback to a controller 202. In particular, the controller 202 may receive a load sense 204 and/or RPM feedback 206 from the service engine 32. The controller 202 also may receive output load sense 208 from one or more of the Loads A, B, and C (e.g., compressor 38, pump 36, and generator 34). In addition, the controller 202 may receive operator input 210 regarding desired services, priority of the Loads A, B, and C, and so forth. In response to the load sense 204, the RPM feedback 206, and/or the output load sense 208, the controller 202 provides an RPM set-point 212 to the service engine 32 and/or load control 214 to the various Loads A, B, and C (e.g., compressor 38, pump 36, and generator 34).

In the illustrated embodiment, the controller 202 is configured to manage or control all or part of the major power or load functions of the unit. For example, the controller 202 may utilize the engine load sense 204 signal from the service engine 32 to determine how much additional load can be applied to the engine 32 without overloading the engine 32. For example, the load sense 204 may include a measurement of horsepower, torque, exhaust temperature, fuel injection quantity, throttle/actuator position, or another suitable measurement directly associated with the service engine 32. By further example, the load sense 204 may use throttle/actuator position of a carburetor or fuel injection system as a measurement of fuel quantity being injected into the service engine 32, which in turn provides an indication of load on the service engine 32. Thus, an increase in fuel injection may indicate an increase in load on the service engine 32, whereas a decrease in fuel injection may indicate a decrease in load on the service engine 32. If the load sense 204 indicates or predicts an overload condition on the service engine 32, then the controller 202 can adjust or turn on/off the output to the various Loads A, B, and C (e.g., compressor 38, pump 36, and generator 34) via the load control 214, thereby reducing or preventing the possibility of overloading the service engine 32.

In certain embodiments, the controller 202 utilizes both the engine load sense 204 signal along with the engine RPM feedback 206 signal to accurately determine and manage the load on the service engine 32. The controller 202 can then determine the current load, remaining available load that can be applied to the engine 32 for a given RPM, and any potential overload condition based on the load sense 204 signal, RPM feedback 206 signal, and RPM set-point 212.

In some embodiments, the controller 202 may utilize the output load sense 208 signal alone or in combination with the load sense 204 signal and/or RPM feedback 206 signal to accurately determine and manage the load on the service engine 32. For example, the output load sense 208 signal may relate to a pneumatic load 216 associated with pneumatic power 218 generated by the air compressor 38. The pneumatic load 216 may relate to air pressure, air flow rate, or some other suitable load measurement. The output load sense 208 signal may relate to a hydraulic load 220 associated with hydraulic power 222 generated by the hydraulic pump 36.

The hydraulic load 220 may relate to hydraulic pressure, hydraulic flow rate, or some other suitable load measurement. The output load sense 208 signal may relate to an electrical load 224 associated with AC/DC electrical power 226 generated by the generator 34. Likewise, the output load sense 208 signal may relate to an electrical load 228 associated with AC electrical power (fixed frequency) 230 generated by a synthetic power converter 232 coupled to the generator 34. The electrical loads 224 and 228 may relate to current, voltage, or some other suitable load measurement. Each of these load signals 216, 220, 224, and 228 of the output load sense 208 may be used alone or in combination with the engine load sense 204 and/or RPM feedback 206 to make load adjustments and/or engine adjustments to power match the service engine 32 with the various Loads A, B, and C (e.g., compressor 38, pump 36, and generator 34).

The controller 202 is configured to generate and transmit load control signals 234, 236, 238, and 240 via the load control 214 to the compressor 38, the hydraulic pump 36, the generator 34, and the synthetic power converter 232 based on load sense 204, the RPM feedback 206, and/or the output load sense 208. For example, the controller 202 may be configured to selectively engage or disengage one or more of the loads (e.g., compressor 38, pump 36, generator 34, and converter 232), individually adjust output levels of the loads, or a combination thereof. For example, the controller 202 may provide load control 214 (via signals 234, 236, 238, and 240) that prioritizes the various loads, and then shuts off and/or reduces output of the less important loads if the service engine 32 cannot meet the demands. For example, the operator input 210 may prioritize the loads as: (1) electrical power 226, (2) pneumatic power 218, (3) electrical power 230, and (4) hydraulic power 222. However, any other prioritization of the loads may be selected by the user or set as a default for the controller 202. If the controller 202 then receives load sense 204, RPM feedback 206, and output load sense 208 indicative of a possible overload condition on the engine 32, then the controller 202 may provide load control 214 that increases the RPM set-point 212 and/or reduces or shuts off the lowest priority load (e.g., hydraulic power 222). If this is sufficient to prevent an overload condition, then the controller 202 may not make any further changes until the controller 202 identifies another potential overload condition. If this is not sufficient to prevent the overload condition, then the controller 202 may take further measures. For example, the controller 202 may provide load control 214 that further increases the RPM set-point 212 and/or reduces or shuts off the next lowest priority load (e.g., electrical power 230). If this is sufficient to prevent an overload condition, then the controller 202 may not make any further changes until the controller 202 identifies another potential overload condition. However, again, if this is not sufficient to prevent the overload condition, then the controller 202 may take further measures continuing with the next lowest priority loads. In each step, the controller 202 may reduce output and/or disconnect devices coupled to the various loads (e.g., compressor 38, pump 36, generator 34, and converter 232).

Likewise, the controller 202 may provide load control 214 that prioritizes the various loads (e.g., compressor 38, pump 36, generator 34, and converter 232), and then turns on and/or increases power output of the loads in order of priority if the service engine 32 exceeds the demands. In other words, the controller 202 can make adjustments for both overload and under load conditions to better power match the capabilities of the service engine 32 with the loads (e.g., compressor 38, pump 36, generator 34, and converter 232). For example, in the case of an under load condition (e.g., wasted power), the controller 202 may simply reduce the RPM set-point 212 if additional output power is not needed from the compressor 38, pump 36, generator 34, or converter 232. Otherwise, if there is an under load condition and a need for additional output power, then the controller 202 may increase pneumatic power 218, hydraulic power 222, electrical power 226, and/or electrical power 230. Again, the controller 202 may increase power based on the priority of loads (e.g., compressor 38, pump 36, generator 34, and converter 232). Thus, if the highest priority is pneumatic power 218, then the controller 202 may increase pneumatic power 218 prior to increasing hydraulic power 222. However, any suitable priority of loads is within the scope of the disclosed embodiments.

In certain embodiments, the service pack 12 may include a direct coupling, belt and pulley system, gear and chain system, clutch system, or a combination thereof, between the service engine 32 and the Loads A, B, and C (e.g., compressor 38, pump 36, and generator 34). As illustrated, the service engine 32 includes a clutch 242 configured to selectively engage and disengage the air compressor 38. Likewise, a clutch may be used between the service engine 32 and the hydraulic pump 36 and/or the generator 34. The clutch 242 may be used to remove or add a load (e.g., compressor 38) to the service engine 32 based on the load control 214. In some embodiments, the system 200 may include a switch, valve, or other actuator configured to engage and disengage each load, either individually or collectively with the other loads. Thus, the controller 202 can more closely power match the service engine 32 with the various loads (e.g., compressor 38, pump 36, generator 34, and converter 232).

FIG. 6 is a flow chart illustrating an embodiment of a load control process 300 for the service pack 12 of FIGS. 1-4. As illustrated, the process 300 receives inputs from a crane control 302 and a stationary control 304, and determines a minimum engine load and RPM setting (block 306). For example, the inputs 302 and 304 may provide an initial indication of load (e.g., hydraulic, electrical, and/or pneumatic), which the process 300 uses to set the initial engine load and RPM setting (block 306) at levels expected to provide a power match. In other words, the initial setting at block 306 may be expected to tailor the engine output to the expected loads, such that neither an overload or under load condition would occur. At block 308, the process 300 proceeds to set or ramp up the service engine 32 to a RPM set-point 310. The process 300 may then determine an actual engine load (block 312) based on various load sense signals. For example, the process 300 may acquire an engine load sense 314 associated with the service engine 32, a RPM sense 316 associated with the service engine 32, and an output load sense 318 associated with the various loads (e.g., compressor 38, pump 36, generator 34, and converter 232). At block 320, the process 320 may evaluate whether the actual engine load indicates a need to control the loads and/or engine RPM based on a priority scheme. For example, if the block 320 indicates an overload condition or an under load condition, then the process 300 may proceed to provide load control 322 as discussed above. Otherwise, the process 300 may continue monitoring loads on the engine as discussed above.

In the illustrated embodiments, the process 300 uses the controller 202 to continuously monitor the engine load via engine load sense 314, engine RPM via RPM sense 316, loads applied to the engine 32 via output load sense 318, and new load inputs from the user interfaces 302 and 304. In turn, the process 300 uses the controller 202 to determine under utilization (e.g. excess engine power) or over utilization (e.g., over power or overload condition), and specifically determine an amount of under or over utilization of the engine 32. Based on this amount, the process 300 uses the controller 202 to selectively apply or remove certain loads at suitable levels to power match the loads with the engine 32. In other words, a goal may be to neither waste power nor over power the engine 32. Thus, the process 300 may engage or disengage (either partially or entirely) the various loads based on an order of priority. For example, the process 300 may first attempt a load decrease to power match the engine 32 with the loads. If this decrease does not entirely match engine power with the loads, then the process 300 may completely cut the particular load. In addition to engaging or disengaging the various loads, the process 300 may increase or decrease the RPM set-point of the service engine 32 in an attempt to power match the engine with the loads.

For example, the process 300 may use the controller 202 to determine and adjust the RPM set-point 310 of the engine 32 to adjust for the various loads (e.g., compressor 38, pump 36, generator 34, and converter 232). In certain embodiments, the process 300 may use a step function RPM control, or a continuously variable RPM control, or another suitable RPM control. The step function RPM control may include a plurality of RPM steps, such as 1800, 2000, 2200, 2400, 2600, 2800, 3000, 3200, 3400, 3600 RPM, or any combination thereof. The continuously variable RPM control may be adjustable to any RPM between a minimum RPM and a maximum RPM, e.g., 1800-3600 RPM. The continuously variable RPM control effectively matches the engine output and RPM to the actual load. If the process 300 indicates a low load or no load condition, then the process 300 can control the loads and service engine 32 to operate at a reduced RPM for significant improvements in noise reduction and fuel economy.

As set forth below, TABLE 1 illustrates a load control, priority, and RPM matrix in accordance with an embodiment of the controller 202 and process 300. As illustrated, the controller 202 and process 300 may operate in several different modes. In the illustrated embodiment, the controller 202 and process 300 may employ a first mode with the compressor 38 turned off and the hydraulic pump 36 turned on, a second mode with the compressor 38 turned on and the hydraulic pump 36 turned off, and a third mode with the compressor 38 turned on and the hydraulic pump 36 turned on. In each mode, the controller 202 and process 300 may include a plurality of priority levels, e.g., (1) auxiliary power, (2) synthetic auxiliary power, (3) hydraulic pump, and (4) compressor. In addition, in each mode, the controller 202 and process 300 may include multiple RPM set-points (e.g., four) and associated service output levels for each of the priority levels. For example, the controller 202 and process 300 may provide greater output levels of synthetic auxiliary power at greater RPM set-points, greater output levels of hydraulic pump pressure at greater RPM set-points, and so forth. By further example, the controller 202 and process 300 may provide synthetic auxiliary power, hydraulic pump pressure, compressor air pressure, and other services as desired (i.e., based on actual demand) at certain RPM set-points. In the illustrated embodiment, the controller 202 and process 300 may selectively control the mode of operation (e.g., mode 1, 2, or 3), the RPM set-points, and the loads based on priory levels. In this manner, the controller 202 and process 300 can more closely power match the capabilities of the service engine 32 with the actual demands of the various loads.

TABLE 1

| Mode: | | 1 | 1a | 1b | 1c | 1d |
|---|---|---|---|---|---|---|
| Compressor: Off<br>Hydraulic Pump: On | | | | | | |
| Engine Rpm | | Minimum | 1800 | 2200 | 3200 | 3600 |
| Priority | 1 | Aux Power | <60 watts | <60 watts | <60 watts | >60 watts |
| Priority | 2 | Synthetic Aux Power | <500 watts | >500 watts | As required | As required |
| Priority | 3 | Hydraulic Pump | <400 psi | <400 psi | <400 psi (As required) | As required |
| Priority | 4 | Compressor, Off | 0 psi | 0 psi | 0 psi | 0 psi |
| | | Control | Unload | Unload | Unload | Unload |
| | | Clutch | Disengaged | Disengaged | Disengaged | Disengaged |

| Mode: | | 2 | 2a | 2b | 2c | 2d |
|---|---|---|---|---|---|---|
| Compressor: On<br>Hydraulic Pump: Off | | | | | | |
| Engine Rpm | | Minimum | 1800 | 2200 | 3200 | 3600 |
| Priority | 1 | Aux Power | <60 watts | <60 watts | <60 watts | >60 watts |
| Priority | 2 | Synthetic Aux Power | <500 watts | >500 watts | As required | As required |
| Priority | 3 | Compressor, On | 100-175 psi (As required) | 100-175 psi (As required) | 100-175 psi (As required) | 100-175 psi (As required) |
| | | Control | Regulated | Regulated | Regulated | Regulated |
| | | Clutch | Engaged | Engaged | Engaged | Engaged |
| Priority | 4 | Hydraulic, Bypass | Bypass | Bypass | Bypass | Bypass |

TABLE 1-continued

| Mode: | | 3 | 3a | 3b | 3c | 3d |
|---|---|---|---|---|---|---|
| Dual Mode: Hydraulic/Compressor: On | | | | | | |
| Engine Rpm | | Minimum | 1800 | 2200 | 3200 | 3600 |
| Priority | 1 | Aux Power | <60 watts | <60 watts | <60 watts | >60 watts |
| Priority | 2 | Synthetic Aux Power | <500 watts | >500 watts | As required | >500 watts |
| Priority | 3 | Hydraulic Pump | <400 psi | <400 psi | >400 psi (As required) | As required |
| Priority | 4 | Compressor, On | 30-175 psi (As required) | 30-175 psi (As required) | 30-175 psi (As required) | 30-175 psi (As required) |
| | | Control Clutch | Regulated Engaged | Regulated Engaged | Regulated Engaged | Regulated Engaged |

Key

Critical load step

Critical load step and Power Management required to manage engine RPM and load.

FIG. 7 is a graph 350 illustrating load sense signals 352 used by the load control system and process of FIGS. 5 and 6, wherein the load sense signals 352 relate to an electronic governor proportional solenoid actuator signal in the service pack 12 in accordance with certain embodiments of the invention. As discussed below, the actuator controls fuel injection into the service engine 32, and the quantity of fuel injection is related to the engine load. For example, the actuator may convert a pulse width modulated (PWM) signal from the controller, to an output rod position, proportional to the duty cycle of the PWM signal. The output rod position controls the quantity of fuel injection into the service engine 32. Thus, characteristics of the actuator (e.g., position or voltage) can be used to determine the engine load for use in the load control system and process of FIGS. 5 and 6.

As illustrated, the load sense signals 352 represent a relationship of actuator voltage 354 versus engine load 356 (e.g., horsepower). The load sense signals 352 include four different signals at different engine RPM settings, including a 3600 RPM load sense signal 358, a 3000 RPM load sense signal 360, a 2600 RPM load sense signal 362, and a 2200 RPM load sense signal 364. In general, the load sense signals 352 indicate a trend of increasing actuator voltage 354 with increasing engine load 356. Thus, the control system and process of FIGS. 5 and 6 may use this relationship, the engine RPM, and the actuator voltage 354 to determine engine load 356, which in turn can be used to adjust the engine RPM and various loads (e.g., compressor 38, pump 36, generator 34, and converter 232) to prevent an overload or under load condition on the engine 32. Likewise, the control system and process of FIGS. 5 and 6 may use this relationship between actuator and engine load based on similar inputs, such as the physical position or setting of the actuator rather than voltage.

In certain embodiments, the engine load sense can be obtained by a direct sensing method and/or an indirect sensing method. For example, the engine load sense can be obtained by a direct sensing method by utilizing a torque transducer located between the engine 32 and a load (e.g., compressor 38, pump 36, generator 34, and converter 232). By further example, the engine load sense can be obtained by an indirect sensing method by measuring the quantity of fuel, air, or both, delivered to the service engine 32 (e.g., CI engine or SI engine). Indirect measurements of the quantity of fuel or load for the service engine 32 (e.g., CI engine) can be obtained by multiple methods including, e.g., conditioned output signal from the engine electronic control unit (ECU) proportional to the quantity of fuel injected or rack position. For example, the controller 202 and process 300 may monitor the output signal of the ECU to the electronic governor fuel rack actuator and convert this to a rack position. By further example, the controller 202 and process 300 may directly measure the fuel injection pump fuel rack position by use of a LVDT (Linear Variable Differential Transformer) or similar device or sensor. In certain embodiments, the service engine 32 includes an electronic governor with a proportional solenoid actuator, which is driven by a pulse width modulated (PWM) signal. One exemplary embodiment of this proportional solenoid actuator is a Kubota 1105 series electronic governor made by Kubota Corporation of Sakai-City, Osaka, Japan. The PWM signal can be converted and filtered to a DC signal, which is proportional to both the fuel rack position and horsepower load on the service engine 32.

The disclosed embodiments provide several advantages. For example, the load control system 200 and process 300 enables use of a smaller power source, e.g., service engine 32, hydraulic motor, electric motor, battery power, fuel cell, or other alternative power source. The load control system 200 and process 300 enables simultaneous operation of multiple loads, by power managing both the primary power source (e.g., service engine 32) and the loads, thus balancing or limiting functions so as not to overload the primary power source. The load control system 200 and process 300 optimizes usage of the power source (e.g., service engine 32) to provide improved efficiency and/or fuel savings. If the power source is under utilized or over utilized, then the load control system 200 and process 300 adjusts the engine RPM and/or the loads to power match the capabilities of the engine 32 with the loads. As a result of this power match, the size of the service engine 32 can be reduced without risk of an overload condition, poor performance, or poor fuel economy. Likewise, the load control system 200 and process 300 reduces the RPM set-point of the engine 32 when not needed to improve fuel savings. The smaller power source (e.g., service engine 32) also enables a reduction in product size, weight, cost, and noise of the service pack 12. Regarding noise, the load control system 200 and process 300 reduces noise by reducing the engine RPM when not needed for the various loads. Likewise, the load control system 200 and process 300 provides the ability to put components in standby and/or limited power settings until they can be brought back on line.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A service pack, comprising:

an engine;

one or more services driven by the engine, wherein the one or more services comprise a generator, an air compressor, a hydraulic pump, or a combination thereof; and a controller configured to:

determine an engine load directly from the engine based on sensed feedback indicative of at least one engine operating parameter of the engine, wherein the sensed feedback indicative of the at least one engine operating parameter comprises at least two of an engine power, an engine torque, a fuel injection quantity, an engine exhaust temperature, an engine throttle position, or a combination thereof; and control output to the one or more services based at least partially on the engine load.

2. The service pack of claim 1, wherein the controller is configured to determine the engine load based at least partially on a throttle position indicative of a fuel injection into the engine.

3. The service pack of claim 1, comprising the generator, the air compressor, and the hydraulic pump.

4. The service pack of claim 1, wherein the controller is configured to sense an engine RPM of the engine, and the controller is configured to control the output to the one or more services based at least partially on the engine load and the engine RPM.

5. The service pack of claim 1, wherein the sensed feedback indicative of the at least one engine operating parameter comprises at least three of an engine power, an engine torque, a fuel injection quantity, an engine exhaust temperature, an engine throttle position, or a combination thereof.

6. The service pack of claim 1, wherein the controller is configured to determine an external load separate from the engine, wherein the external load includes at least one of an electrical generator load, a hydraulic pump load, a compressor load, or a combination thereof.

7. A system, comprising:

a load priority controller configured to sense engine load associated with an engine based on load sense feedback, wherein the load sense feedback comprises:

first load sense feedback indicative of an engine load measured directly from the engine, wherein the first load sense feedback relates to at least one engine operating parameter and includes at least one fuel injection parameter relating to a fuel injection quantity or a throttle position of the engine; and second load sense feedback indicative of a hydraulic load associated with a hydraulic pump coupled to the engine, a pneumatic load associated with a compressor coupled to the engine, an electric load associated with a generator coupled to the engine, or a combination thereof;

wherein the load priority controller is configured to control the engine, the hydraulic pump, the compressor, the generator, or a combination thereof, in response to the load sense feedback and a priority control scheme.

8. The system of claim 7, wherein the priority control scheme comprises an order of priority of external loads on the engine.

9. The system of claim 8, wherein the priority control scheme comprises a plurality of modes of load priority control, and each mode comprises output settings for the external loads based at least partially on different engine RPM states of the engine.

10. The system of claim 9, wherein the external loads comprise the hydraulic load, the pneumatic load, and the electrical load.

11. The system of claim 7, wherein the first load sense feedback relating to the least one engine operating parameter further includes at least one of an engine power, an engine torque, an engine exhaust temperature, or a combination thereof.

12. The system of claim 7, wherein the load priority controller is configured to execute the priority control scheme based on an engine RPM and the load sense feedback.

13. The system of claim 12, wherein the load sense feedback comprises the engine load measured directly from the engine, the hydraulic load, the pneumatic load, and the electric load.

14. The system of claim 7, comprising the engine, the hydraulic pump, the compressor, and the generator all disposed in a service pack.

15. A method of managing power of an engine-driven system, comprising:

obtaining load feedback associated with an engine, wherein the load feedback comprises:

first load feedback indicative of an engine load sensed directly from the engine, wherein the first load sense feedback relates to a least one engine operating parameter of the engine; and second load sense feedback indicative of an external load driven by the engine, wherein the external load comprises a hydraulic pump, a compressor, a generator, or a combination thereof; and adjusting the engine and the external load in response to the load feedback and one or more limits associated with the engine, wherein adjusting the engine and the external load comprises substantially power matching the engine to the external load.

16. The method of claim 15, comprising measuring an engine RPM of the engine, wherein obtaining load feedback comprises measuring an engine throttle setting and/or a fuel injection parameter, and wherein adjusting the engine and the external load is based at least partially on the measured engine RPM and the measured engine throttle setting and/or the measured fuel injection parameter.

17. The method of claim 15, wherein substantially power matching comprises substantially preventing, reducing, or eliminating an overload condition or an under load condition of the engine.

* * * * *